US006255931B1

(12) United States Patent
Chen

(10) Patent No.: US 6,255,931 B1
(45) **Date of Patent: *Jul. 3, 2001**

(54) HIPOT BARRIER STRUCTURE FOR TRANSFORMER

(75) Inventor: James Chien-Chung Chen, Taipei (TW)

(73) Assignee: Atech Technology Co., Ltd., Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/201,862

(22) Filed: Dec. 1, 1998

(51) Int. Cl.[7] ..... H01F 27/29; H01F 27/30
(52) U.S. Cl. ..... 336/198; 336/208; 336/192
(58) Field of Search ..... 336/198, 208, 336/90, 192, 197

(56) References Cited

U.S. PATENT DOCUMENTS 5,157,368 * 10/1992 Okano et al. ..... 336/198

* cited by examiner

*Primary Examiner*—Anh Mai
(74) *Attorney, Agent, or Firm*—Dougherty & Troxell

(57) ABSTRACT

A hipot barrier structure for a transformer for preventing instantaneous hipot from transiting from pins at high-tension side to pins at low-tension side directly via a conductive core of the transformer, so that damages to the whole circuitry can be avoided to comply with required safety code. The barrier structure includes a barrier member made of insulating material and having a generally C-shaped cross-section for fitly covering the high-tension side of the core in a tight fit relation and forming an outer layer of the core at the high-tension side. The barrier member increases a creepage distance between the pins and the conductive core and therefore effectively prevents a hipot from directly crossing over the core.

1 Claim, 3 Drawing Sheets

HIPOT BARRIER STRUCTURE FOR TRANSFORMER

BACKGROUND OF THE INVENTION

The present invention relates to a hipot barrier structure for a transformer, and more particularly to an insulating barrier member having substantially C-shaped cross-section for tightly fitting onto a high-tension side of a core of the transformer. The barrier member forms an outer layer at the high-tension side of the core to increase a creepage distance between the core and pins on the transformer located closely to the core, so that hipot, if any, would not directly flow across the core from the adjacent pins.

It is known that transformers are required components in an electronic circuitry. With the even thinner, lighter and compact volume designed for existing circuit boards, the transformers are also designed to meet the requirement of miniaturization. Meanwhile, there are different safety codes for different electronic parts used for different purposes. Only those qualified and certified electronic parts can be used to protect other components in the same circuitry. Among the American and European electronic safety codes adopted by all countries in the world, there is one safety code about grades of creepage distance between the pin and the core of a transformer. The creepage distance is defined by the length of a line extending along a surface of a bobbin of the transformer between an end of the pin connected to the bobbin and one side of the core adjacent to the pin. Such creepage distance differs with different grades under the safety code, but there is always a minimum safety distance specified by the codes. When a creepage distance is smaller than a specified safety grade, it means the distance between the pin or pins and the core is too short to prevent a hipot, which might occur, for example, at a lightning, from transmitting from the pins at a high-tension side to the pin or pins connected to the other side (or the low-tension side) of the bobbin by directly crossing over the core, and would therefore cause damage to other components in the circuitry.

It is necessary to solve the problem of short creepage distance between the core and the adjacent pins in the transformer to meet the safety code and avoid damage caused by hipot directly crossing over the core.

SUMMARY OF THE INVENTION

A primary object of the present invention is to provide a hipot barrier structure for a transformer. An insulating barrier member having a substantially C-shaped cross-section is fitted onto one side of the core adjacent to pins connected to the bobbin of the transformer, so that the barrier member forms an insulating outer layer at that side of the core. The barrier member also increases the creepage distance between the pins and the core to effectively prevent a hipot from directly crossing over the core and thereby provides enhanced safety effect.

DETAILED DESCRIPTION OF THE PREFERRED EMBODIMENTS

Figure 1:
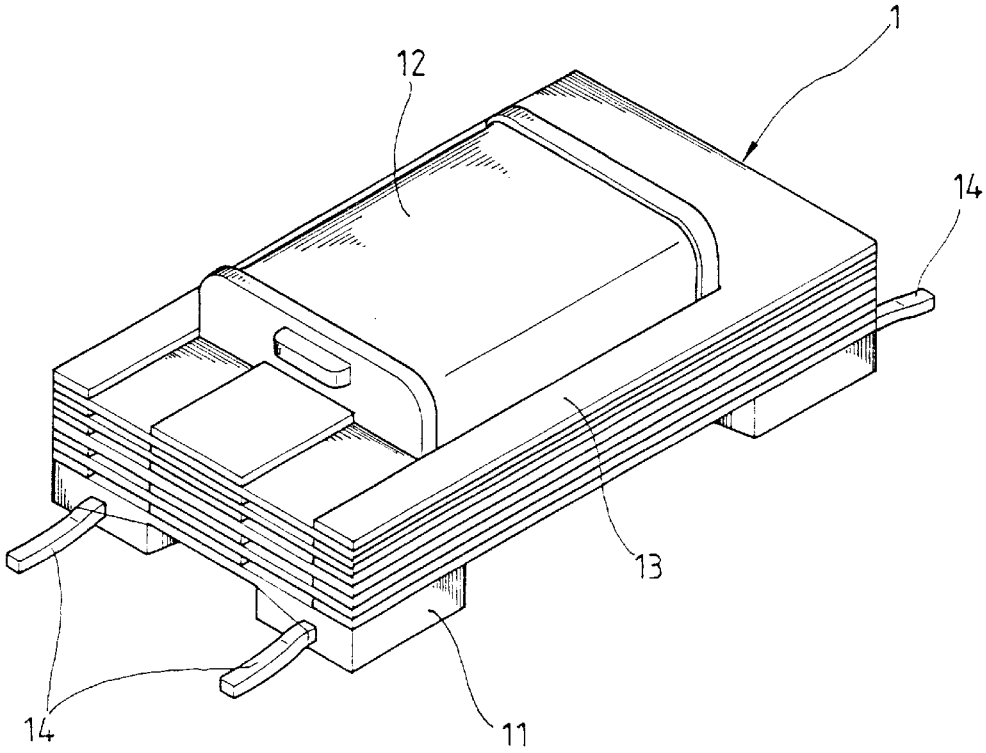
FIG. 1 (PRIOR ART)
FIG. 1 is a perspective of a conventional transformer.
Figure 2:
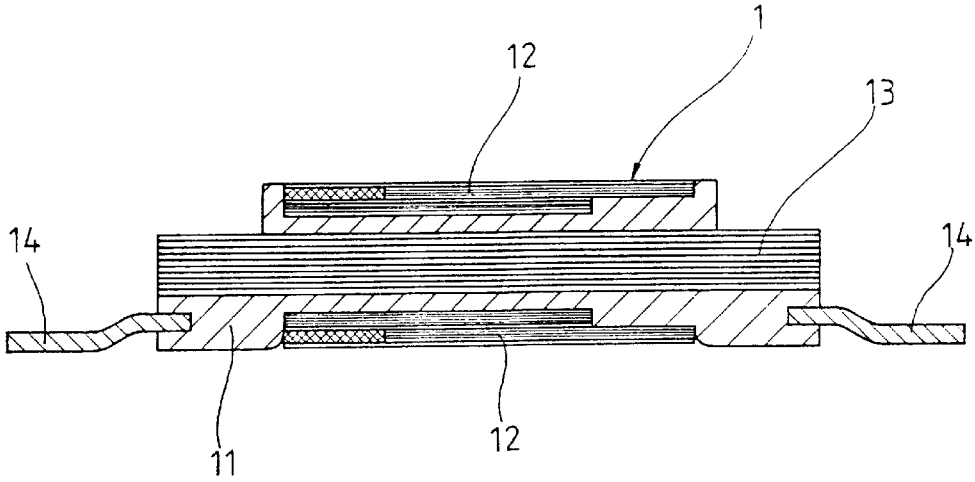
FIG. 2 (PRIOR ART)
FIG. 2 is a side sectional view of the transformer of FIG. 1.

Please refer to FIGS. 1 and 2 that are perspective and side sectional views, respectively, of a conventional transformer 1. As shown, the transformer 1 mainly includes a bobbin 11, a winding 12, a core 13, and pins 14 separately connected to two opposite side surfaces of the bobbin 11. The transformer 1 is very thin, light and small in volume, and therefore, a creepage distance, that is, a line extending along the side surface of the bobbin 11 from one side of the core 13 to the pins 14 adjacent to that side is extremely short. At the occurrence of a hipot, the hipot tends to transit from the pins adjacent to a high-tension side of the core 13 to other pins 14 connected to the opposite side surface of the bobbin 11 by directly crossing over the core 13. This condition would cause damage to other elements in the same circuitry due to high-tension impact. It is important to solve this problem without adversely affecting the small size of the Transformer.

Figure 3:
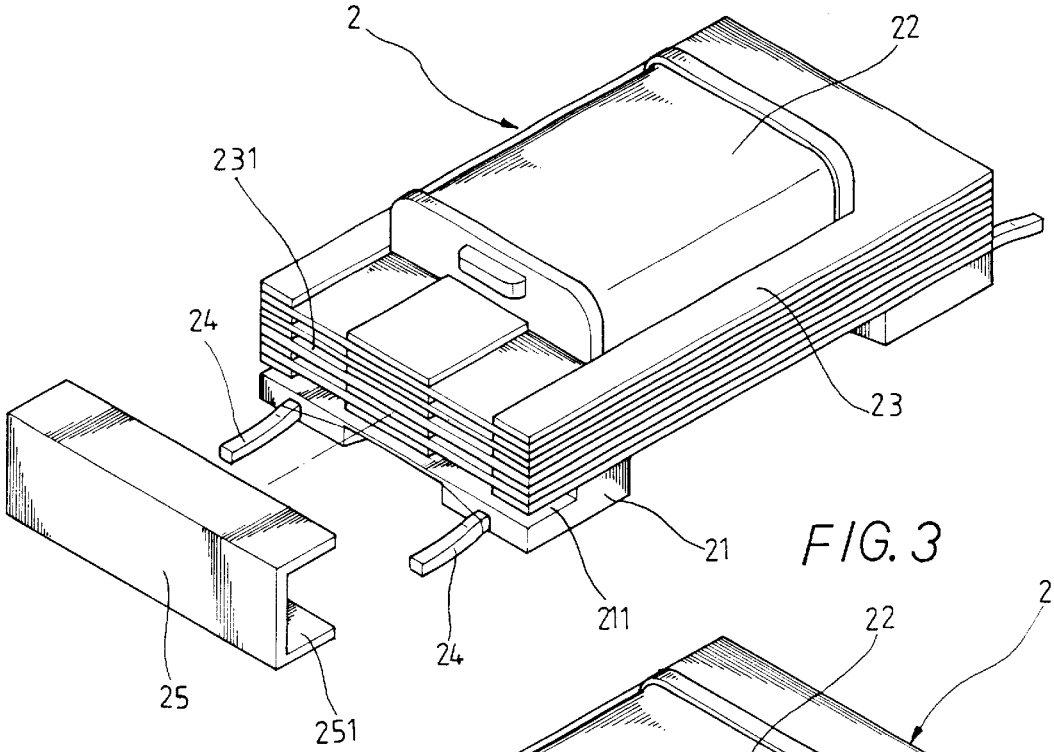
FIG. 3 is an exploded perspective showing the transformer and the hipot barrier member according to the present invention.
Figure 4:
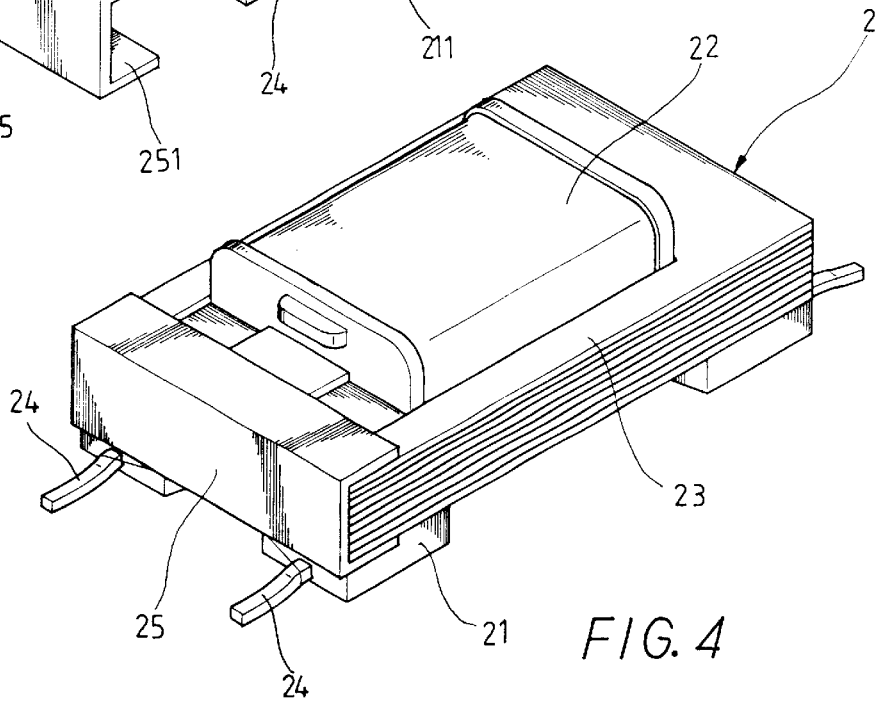
FIG. 4 is an assembled perspective view of the transformer of FIG. 3.
Figure 5:
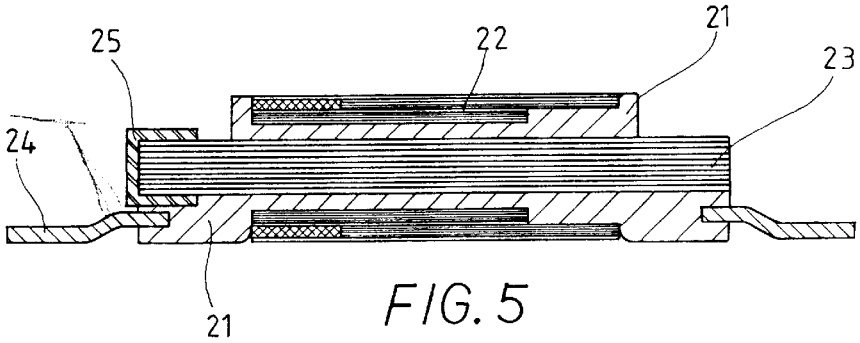
FIG. 5 is a side sectional view of the transformer of FIG. 4.

FIGS. 3, 4 and 5 are sequentially an exploded perspective, an assembled perspective, and a side sectional view of a transformer 2 according to the present invention. Like the conventional transformer 1, the transformer 2 also includes a bobbin 21, a winding 22, a core 23, and pins 24 connected to two opposite side surfaces of the bobbin 21. However, the transformer 2 is provided with a hipot barrier structure. A barrier member 25 is additional provided to fitly cover a high-tension side 231 of the core 23 adjacent to the pins 24 which includes a riser 24*a*. The barrier member 25 is preferably made of plastic material through injection molding to serve as an insulator. The barrier member 25 is a long member having a substantially C-shaped cross-section that defines a sideward-facing opening. The opening of the barrier member 25 has a width just for engaging with the high-tension side 231 of the core 23 therein in a tight fit relation and thereby forms a protective outer layer covering the side 231 of the core 23 and portions of the core 23 adjacent to upper and lower edges of the side 231. For the barrier member 25 to easily and firmly fit over the side 231, the bobbin 21 is provided with a recess 211 at a position near and above the pins, 24 but below the core 23 at the time the bobbin 21 is formed, such that the a lower wing portion 251 of the C-shaped barrier member 25 can be fitly located in the recess 211 between the bobbin 21 and the core 23, as can be clearly seen from FIG. 5. By engagement of the lower wing portion 251 of the barrier member 25 with the recess 211 of the bobbin 21, the whole barrier member 25 can tightly cover the side 231 of the core 23 and form a outer layer thereof without easily separating from the core 23. After the barrier member 25 has been covered onto the side 231, the line defining the creepage distance between the core 23 and the adjacent pin 24 not only extends along the side surface of the bobbin 21 to which the pin 24 is connected but also an outer surface of the barrier member 25. That is, the creepage distance between the pin 24 and the core 23 is largely increased to sufficiently prevent a hipot from transiting from the pins 24 at the high-tension side 231 to the pins 24 at the opposite side on the transformer 2 by directly crossing over the core 23. Therefore, the transformer 2 is improved to meet the required safety code without increasing the size of the transformer.

Figure 6:
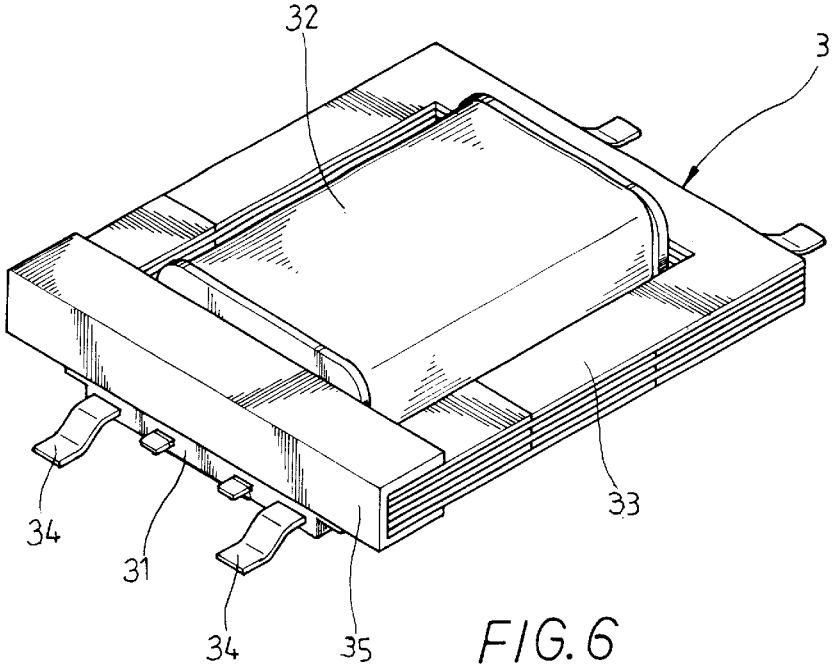
FIG. 6 is an assembled perspective of a variant of the transformer with the hipot barrier structure according to the present invention.
Figure 7:
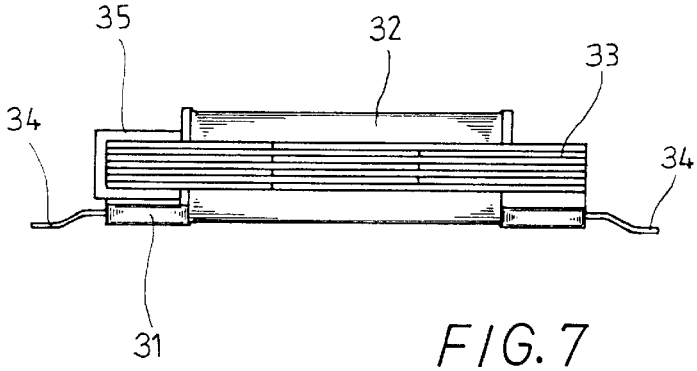
FIG. 7 is a side view of the transformer of FIG. 6.

FIGS. 6 and 7 are perspective and side sectional views, respectively, of a variant of the transformer according to the present invention. As shown, a transformer 3 is structurally similar to the transformer 2 and includes a bobbin 31, a winding 32, a core 33, and pins 34 which includes a riser 34*a* connected to two opposite side surfaces of the bobbin 31. A barrier member 35 similar to the barrier member 25 is provided to cover one high-tension side of the core 33 to sufficiently increase a creepage distance between the pins 34 and the core 33 to effectively prevent undesired transition of an instantaneous high potential.

Figure 8:
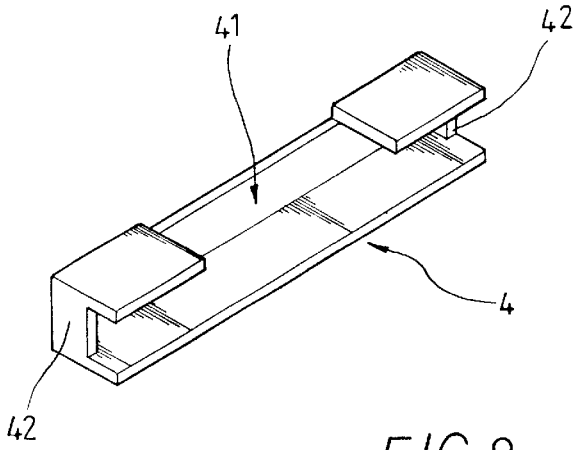
FIG. 8 is a perspective view showing another embodiment of the hipot barrier member according to the present invention.

Furthermore, modifications can be made to the C-shaped barrier members 25 and 35 illustrated in FIGS. 3 and 6 without adversely affecting the provision of a minimum creepage distance between the pins to the core meeting the required safety code. FIG. 8 illustrates a barrier member 4 that has a substantially C-shaped cross section but with a middle portion of its upper wing portion cut away to form an opening 41. Or, the barrier member 4 is provided at two ends with extended wall portions 42 to further cover portions on the core 23 or 33 adjacent to two ends of the high-tension side.

What is claimed is:

1. A transformer having a hipot barrier structure, said transformer including a bobbin, a winding, a core including a high tension side having upper and lower edges and laterally extending pins each of which include a riser therein separately connected to two opposite sides of said bobbin, said bobbin includes a recess near and above said pins but below said high tension side of said core; and said hipot barrier structure comprising a longitudinally extending insulating member having a C-shaped cross section, two extended wall portions and a wing portion, said insulating member engaging one high tension side of said core adjacent to said pins in a tight fit relation with said wing portion extending into said recess with a tight fit so that said barrier structure firmly covers said high tension side of said core and portions of said core adjacent to said upper and said lower edges of said high tension side and with said extended wall portions further covering portions of the core adjacent to two ends of the high tension side to form an outer layer thereof, and wherein said laterally extending pins extend outward beyond said C-shaped insulating member whereby a creepage distance between said core and said pins is increased due to the C-shaped insulating member between said core and said pins.

* * * * *